US007284923B2

(12) United States Patent
Holtman

(10) Patent No.: US 7,284,923 B2
(45) Date of Patent: Oct. 23, 2007

(54) PRINTER, A SUPPLY UNIT FOR THE PRINTER, AND A MEMBER FOR ACCOMMODATION IN THE SUPPLY UNIT

(75) Inventor: Lodewijk T. Holtman, Venlo (NL)

(73) Assignee: Océ Technologies B.V., Venlo (NL)

( * ) Notice: Subject to any disclaimer, the term of this patent is extended or adjusted under 35 U.S.C. 154(b) by 0 days.

(21) Appl. No.: 11/269,796

(22) Filed: Nov. 9, 2005

(65) Prior Publication Data

US 2006/0104700 A1 May 18, 2006

(30) Foreign Application Priority Data

Nov. 12, 2004 (NL) ..... 1027496

(51) Int. Cl.
*B41J 15/00* (2006.01)
*B41J 29/00* (2006.01)
*B41J 2/315* (2006.01)

(52) U.S. Cl. ..... 400/613; 400/619; 400/709; 400/120.01

(58) Field of Classification Search ..... 400/619, 400/613, 709
See application file for complete search history.

(56) References Cited

U.S. PATENT DOCUMENTS 5,087,313 A * 2/1992 Duecker ..... 156/271
5,921,687 A * 7/1999 Koike et al. ..... 400/120.01
6,007,017 A * 12/1999 Vorwerk ..... 242/563
6,676,312 B2 * 1/2004 Richard ..... 400/242
2001/0006202 A1 * 7/2001 Inana et al. ..... 242/348
2004/0005180 A1 * 1/2004 Narita et al. ..... 400/120.01
2004/0161253 A1 * 8/2004 Shibuya et al. ..... 399/49
2004/0175546 A1 * 9/2004 Shacklett et al. ..... 428/195.1
2005/0002718 A1 * 1/2005 Winter et al. ..... 400/579

FOREIGN PATENT DOCUMENTS

JP 59-228670 A 12/1984
NL 0 762 225 A1 * 3/1997

* cited by examiner

*Primary Examiner*—Michael Cygan
*Assistant Examiner*—Jonathan Dunlap
(74) *Attorney, Agent, or Firm*—Birch, Stewart, Kolasch & Birch, LLP

(57) ABSTRACT

A printer including a print unit, a supply unit for holding a web of receiving material wound into a roll, a system for unwinding the web and transporting it for printing to the print unit, which supply unit is adapted to carry an elongate member on which the roll is fixed, substantially concentrically, the elongated member being provided at its peripheral edge with a pattern of sensorially perceptible discrete transitions, which pattern is substantially symmetrical with respect to a reference position on the elongated member and extends from this position to the vicinity of the ends of the elongated member.

11 Claims, 3 Drawing Sheets

PRINTER, A SUPPLY UNIT FOR THE PRINTER, AND A MEMBER FOR ACCOMMODATION IN THE SUPPLY UNIT

BACKGROUND OF THE INVENTION

The present invention relates to a printer comprising a print unit, a supply unit for holding a web of receiving material wound into a roll, and a system for unwinding the web and transporting it for printing to the print unit, which supply unit is adapted to carry an elongated member on which the roll is fixed substantially concentrically. The present invention also relates to a supply unit for holding the receiving material and an elongate member comprising elements for releasable fixing of the receiving material.

In one embodiment of a known printer, a roll of the receiving material is fixed, frequently prior to the placing of the roll in the supply unit, on an elongated member, particularly a cylindrical core, which can be received in bearer elements adapted for this purpose in the supply unit. To unwind the web, the core is rotatably accommodated in the bearer elements. During printing of the receiving material, the required quantity of material is unwound at a time from the roll and the web thus unwound is fed for printing to a print unit, for example an inkjet printhead.

After the web of receiving material has been completely unwound, the core is provided with a new roll of receiving material so that further printing operations, starting from the same position in the supply unit, can take place. Rolls of different widths can be fixed on the core. The advantage of this is that on the basis of one core co-operatively connected to the bearer elements in the supply unit, it is possible to accommodate rolls of different widths in the supply unit. Since rolls of different widths can be fixed on the core, it is advantageous to accurately position such a roll with respect to a reference position on the core. As a result, prior to the unwinding of the web, it is known where the web is situated with respect to the print unit. This simplifies the transport and positioning of the web in the printer.

A known method of positioning the web is placing the roll against a stop, for example a flange, provided on the core. The disadvantage of this method is that the center of the roll does not normally coincide with the center of the printer. To solve this problem it has previously been proposed to position each roll on the core by the use of a movable indication in the supply unit of the printer, the position of such indication corresponding to the width of the roll. This method is complex and prone to faults.

SUMMARY OF THE INVENTION

The object of the present invention is to provide a printer which provides a simple and efficient placing of the roll in the supply unit. To this end, a printer is provided wherein a core member is provided at its peripheral edge with a pattern of sensorially perceptible discrete transitions, which pattern is substantially symmetrical with respect to a reference position on the core member and extends from this position as far as the surroundings of the ends of the member.

The positioning of a roll of receiving material takes place by pushing the roll over the core and so placing it with respect to the core that the projecting parts of the core show an equal part of the pattern (in mirror image form). Since this pattern is sensorially perceptible, there is no need for additional aids during positioning. Simply perceiving those parts of the pattern which project beyond the roll is sufficient to accurately position the roll with respect to the core. If the projecting parts of the pattern are identical, the center of the roll is located at the reference position of the core. In one embodiment, this reference position coincides with the center of the core. The method according to the present invention can be used independently of the roll width. In order to be able to position the roll according to the present invention, with any type of roll suitable for printing with the printer with sufficient accuracy, the pattern must extend at least over a length approximately equal to the widest possible of the roll types. The pattern should therefore extend at least as far as the vicinity of the ends of the core. The pattern is not restricted to any form, but the distance between the discrete transitions in one embodiment should be of the same order of magnitude as the required accuracy for positioning the roll on the core.

The advantage of the present invention is that the printer does not have to be provided with movable positioning aids and it is very simple for the user to accurately position a roll in the printer. This has the advantage that the manner for transporting the unwound web in the printer has to satisfy less stringent requirements. The present invention often serves to compensate for any inaccuracies in the initial position of the roll, which result in inaccurate positioning of the web in the print engine.

In one embodiment, the pattern is such that it includes at least three discrete transitions which differ from one another. This means that each discrete transition, including its adjoining pattern elements, differs from the other two transitions including their adjoining pattern elements. It has been found in this way that any mistakes in perception resulting in faulty positioning occur relatively rarely. Particularly in the case of rollers which are relatively small with respect to the length of the core, it has been found that the number of mistakes can be reduced relatively considerably.

In one embodiment, the pattern comprises at least three consecutive zones extending in the longitudinal direction of the member, the zones being separated from one another by the discrete transitions, which zones have a color indication differing from one another. It has been found that in this embodiment practically no faulty positionings should occur. Visual perceptible transitions, particularly accompanied by intermediate zones with different colors, other than in the case, for example, of pattern elements only in black and white (or colorless) appear to be very suitable for simple determination of when both projecting pattern parts are equal (at least mirror-image symmetrical) to one another. As a result, mistakes should occur only exceptionally, for example in the case of gross negligence of whoever places the roll on the core, or in the case of a special form of color blindness. In another embodiment, no zones having the same color indication occur in a series of consecutive zones in which there are at least three discrete transitions between the zones. As a result, the risk of faulty positioning is further reduced.

In one embodiment, each zone substantially encircles the member. In this embodiment, the member, at least an appreciable part thereof, is surrounded by the zones which, for example, each form a strip of a specific color. As a result, the position of the core with respect to the user positioning the roll on the core is practically no longer important, since the user can perceive the colored pattern on this core irrespective of the core position. This makes it an even more user-friendly way of placing the roll.

In one embodiment, the zones adjoin one another. In this embodiment, the colored zones are not separated by an unmarked zone. This appears to result in fewer mistakes. In addition, in this embodiment, the pattern can be disposed on the core in the form of a continuous element, for example in the form of a sticker, or if required in the form of two identical stickers each disposed on one side of the reference point.

In one embodiment, the web is rolled on a tube, whereby the tube is releasably fixed on the member. In this embodiment the web is wound on the tube in an earlier stage, for example in the factory where the receiving material is produced. The core has a format such that it fits in the tube, for example because the core is a cylinder the outer periphery of which is a fraction smaller than the inner periphery of the tube. The core can, for example, be provided with lugs distributed over its surface, said lugs being radially movable with the position thereof being lockable. By moving these lugs in the radial direction away from the core axis, when the tube has been pushed over the core, the tube is fixed to the core. Locking of the position of the lugs results in a permanent fixing. By unlocking this locking system and moving the lugs back in the direction of the core axis the tube is again released from the core and can be pushed off the core.

In another embodiment the printer is provided with a sensor for measuring the position of a side edge of the unwound part of the web. In this embodiment, the positioning of the roll has to satisfy less stringent requirements because the position of the side edge is determined itself. In this case the positioning must be so accurate that the side edge of the web comes within the window of the sensor. In this case, therefore, it is possible to use a pattern in which the distance between the discrete transitions is of the same order of magnitude as the width of the window of the sensor. For example, if the window is 3 cm wide, then all that is required is a distance of 5-10 cm between the discrete transitions.

In addition to a printer, the present invention also relates to a supply unit for holding a web of a receiving material wound into a roll, including means for rotatably accommodating an elongate member on which the roll is fixed substantially concentrically, the member being provided at its peripheral edge with a pattern of sensorially perceptible discrete transitions, which pattern is symmetrical with respect to a reference position on the member and extends from said position as far as the vicinity of the ends of the member.

The present invention also relates to an elongate member including means for the releasable fixing of a web of receiving material wound into a roll, which member is provided at its peripheral edge with a pattern with sensorially perceptible discrete transitions, such that the pattern is suitable, prior to the said fixing, for positioning the roll on the member, which pattern is symmetrical with respect to a reference position on the member and extends from said position to the vicinity of the ends of the member.

BRIEF DESCRIPTION OF THE DRAWINGS

The present invention will now be explained in detail with reference to the following drawings, wherein.

DETAILED DESCRIPTIONS OF THE INVENTION

Figure 1:
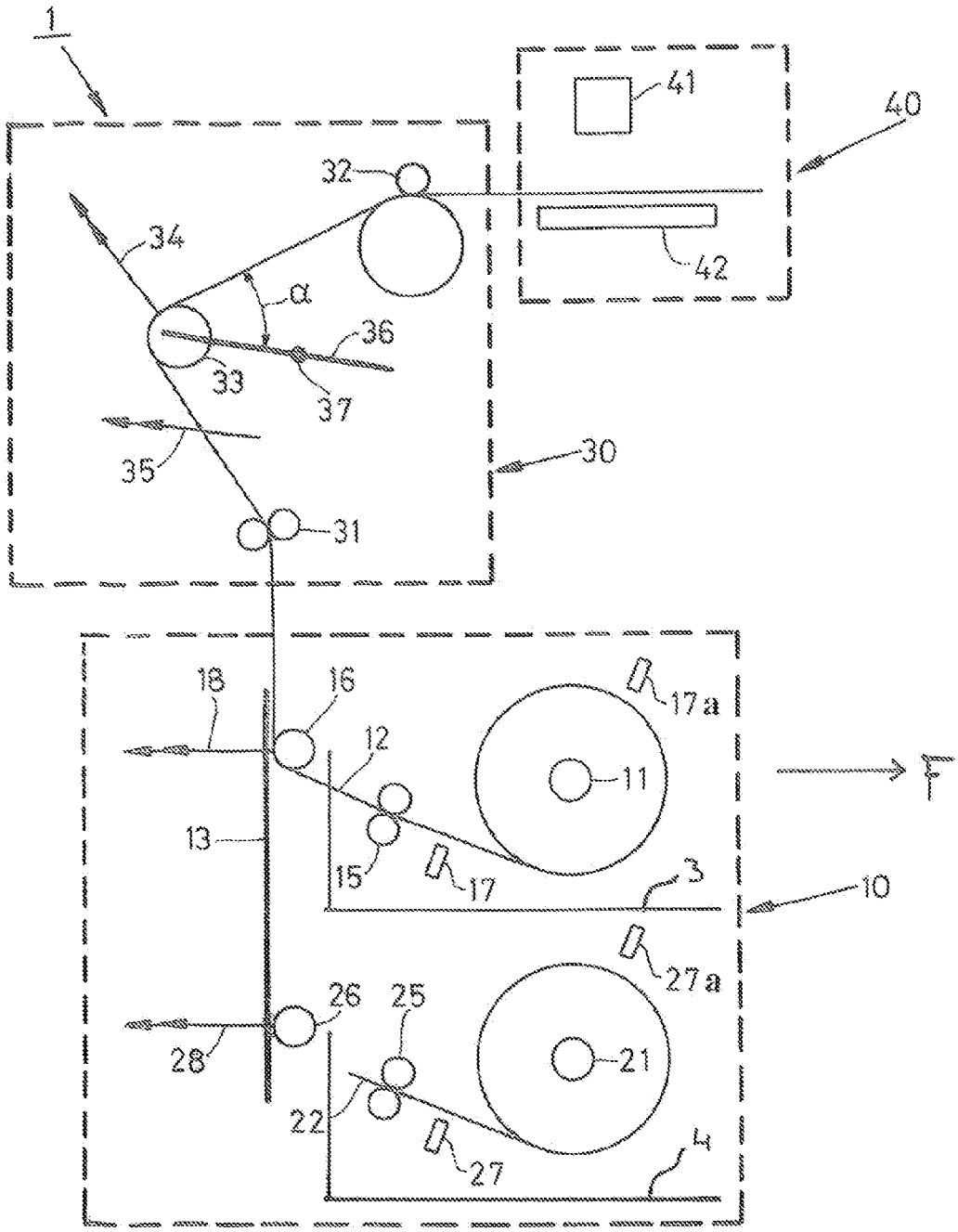
FIG. 1 is a diagrammatic illustration of a printer according to the present invention.

FIG. 1 is a diagram showing a printer according to the present invention. The printer is provided with a supply unit 10 which serves for storage and delivery of the substrate for printing. In addition the printer comprises transport unit 30 which transports the substrate from the supply unit 10 to the print unit 40. Unit 30 also ensures accurate positioning of the substrate in the print zone formed between the print surface 42 and the inkjet printhead 41. In this embodiment, print unit 40 is a conventional engine comprising printhead 41 which is constructed front a number of loose sub-heads, each for one of the colors black, cyan, magenta and yellow. A printhead of this type is described in detail in European patent application EP 1 378 360. Printhead 41 has only a limited print range so that it is necessary to print the image on the substrate in various sub-images. For this purpose, the substrate is transported in increments in each case in the transit direction (subscan direction) so that a new part of the substrate can be printed in the print zone. In the example illustrated, the substrate 12 originates from core 11 containing a roll of substrate, which roll is situated in the supply unit 10. The roll is received in drawer 3 of the supply unit. A web of substrate is wound on the core 11 of the roll and has a length of 200 meters. To accomodate the roll in the printer the drawer 3 is provided with a holder (not shown) to support the core in the surroundings of its ends. As a result, the roll can be accommodated rotatably in the drawer. The holder comprises two support members received in side plates of the drawer, these members being brought into co-operative connection with the ends of the roll. In this embodiment the supply unit is provided with a second drawer 4 to receive a following roll containing a core 21 on which a substrate 22 is wound. This substrate 22 can also be delivered by the supply unit for printing. The drawers can be pushed out of the supply unit 10 in the indicated direction F for the withdrawal of the rolls and/or the insertion of new rolls. For the transport of the substrate, core 11 is operatively connected to transport elements 15, which in this case includes a pair of rollers between which a transport nip is formed. A sensor 17 is mounted upstream of means 15 to determine whether there is still substrate on the roll in the relevant holder. A sensor 17*a* can be provided to measure the position of a side edge of the unwound part of the web. The holder is provided with transport elements 25 for the transport of a substrate orginating from the other roll. Upstream of these elements the supply holder is provided with sensor 27 which has the same action as sensor 17. Similarly, sensor 27*a* has the same function as sensor 17*a*. The supply holder is provided with guide elements 16 and 26 to guide the substrates 12 and 22 respectively to the transport unit 30. Transit path 13 is located downsteam of these guide elements. The transit path is used both for the transport of substrate 12 and the transport of substrate 22.

A substrate leaving the supply unit 10, substrate 12 in this example, is engaged by transport element 31 of the transport unit 30. This transport element transports the substrate via a guide element 33 on to the second transport element 32 of the transport unit 30. The transport means 32 engages the substrate, and transports it on to the print unit 40. Thus the printer is configured to print substrate 12. For configuration to a print substrate 22 it is necessary in this case to wind substrate 12 back on the core 11 so that the free end finally leaves transit path 13. Roller pair 15 then still holds the substrate 12 fast. Substrate 22 can then be spooled over guide element 26 by the drive of the roller pair 25 until nip 31 is reached whereupon the latter takes over the drive for the substrate and spools the substrate on to nip 32 to be finally transfered to the print surface 42. The printer is then configured to print substrate 22.

The guide elements 16 and 26, are in this example, rollers extending parallel to the transport elements 15 and 31; 25 and 31 respectively. They are basically stationary rollers (i.e., they cannot rotate about their axial axis). The guide elements are so disposed in the supply unit so that they can each rotate, at least through a limited angle, about an axis. In the drawing, the rotational axis 18 of element 16 is shown, and also the rotational axis 28 of element 26. These rotational axes are perpendicular to the axes of the guide elements and intersect the middle of these elements.

Guide element 33 of transport unit 30, which element extends substantially parallel to the transport elements 31 and 32, is also so disposed that it can rotate about an axis perpendicular to the axial direction of the said element. The axis is shown by reference 34 and intersects the middle of guide element 33. Since element 33 in this embodiment is a co-rotating roller, the substrate remains substantially stationary with respect to the surface of this guide element. Element 33 is also so suspended that it can rotate about axis 35, which axis extends parallel to the bisector 36 of the angle $2\alpha$ over which the substrate is fed from transport element 31 to transport element 32. The axis 35 intersects the middle of the substrate web at a distance of about 1 meter from the guide element itself.

Guide element 33 is movable from a first position in which said element is situated in FIG. 1, to a second position in which the center of this element coincides with location 37. In the first position, the distance over which substrate 12 extends between transport element 31 and transport element 32 is maximum. In the second position this distance is minimal. Use is made of this during the transport of the substrate to print unit 40. Since the substrate must in each case be moved over a relatively small distance (typically 5 to 10 cm), it is advantageous for this to take place relatively rapidly. However, the mass inertia of roll 11, certainly when it is provided with the maximum quantity of substrate, is relatively high. For that reason, displacement while maintaining the configuration shown for transport elements and guide elements would take relatively considerable time. To counteract this problem, transport element 31 is accelerated much more slowly than transport means 32. In order however to ensure sufficient supply of substrate to transport means 32, the guide element 33 is moved in the direction of location 37.

Figure 2:
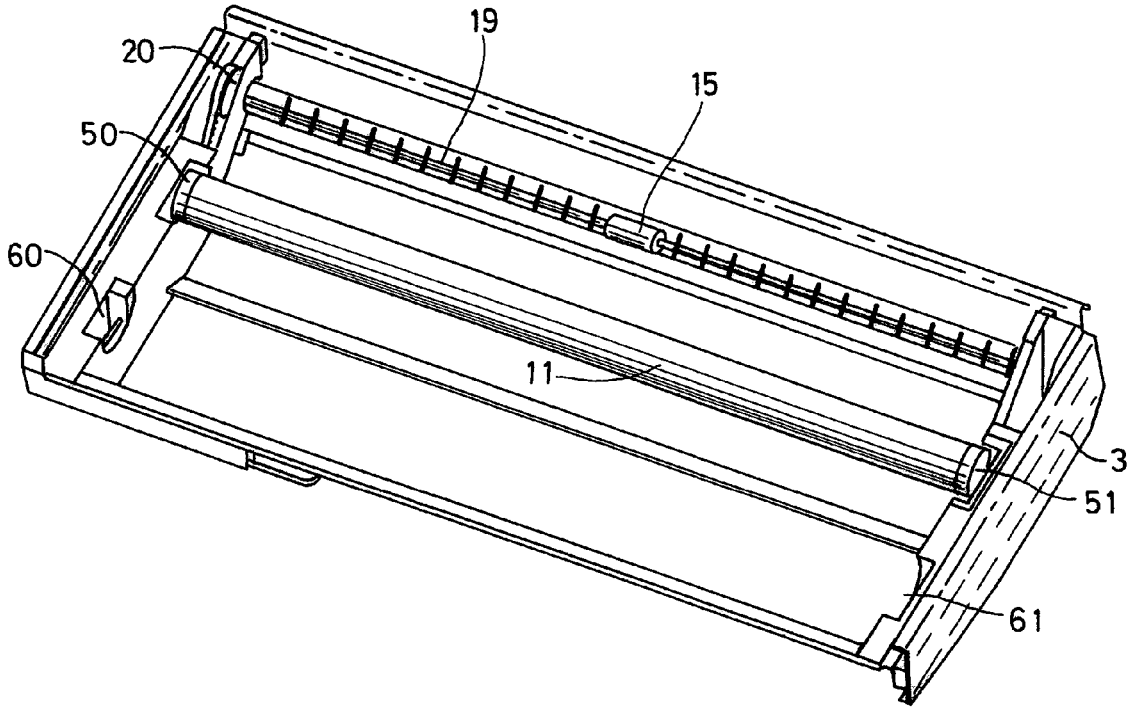
FIG. 2 is a diagram showing a drawer of a supply unit of the printer.

FIG. 2 diagrammatically illustrates an alternative embodiment of the drawer 3. In this case, the drawer is provided with two holders to receive two individual cores. The first holder includes a first pair of support members 50 and 51. The second holder includes a second pair of support members 60 and 61. In the drawing, the core 11 is received in the first holder. When this drawer is in use in a printer the core present therein will be provided with a substrate wound thereon (not shown). To unwind the substrate, the core is rotatably accommodated in the holder. Roller pair 15, of which only one roller is visible in the drawing, also forms part of the drawer. The roller illustrated is mounted on shaft 19 which can be driven by gearwheel 20.

The distance between the support members is such that a user can readily place a roll in the holder by substantially making the ends of the core coincide with the positions of the two support members. After the roll has been placed in the holder, it is automatically brought by a number of resilient elements (not shown) into a substantially fixed position with respect to the print surface.

Figure 3A:
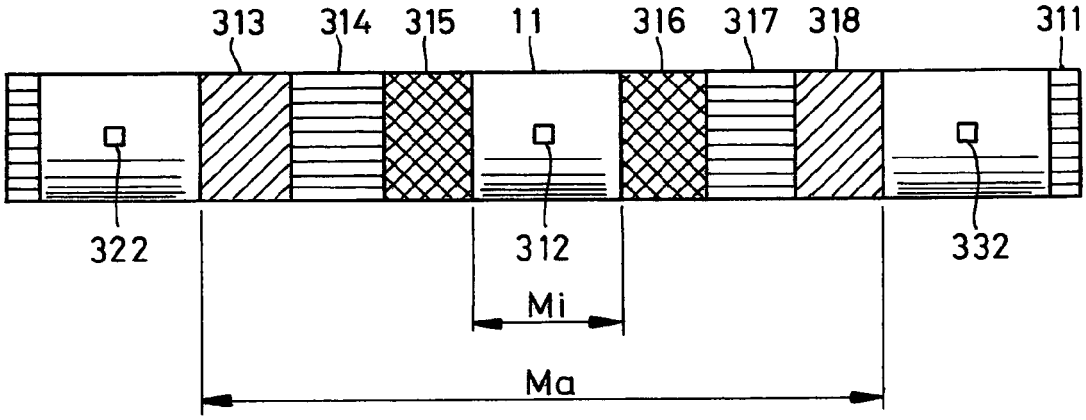
FIGS. 3A and 3B are diagrams showing a core provided with a pattern according to the present invention.
Figure 3B:
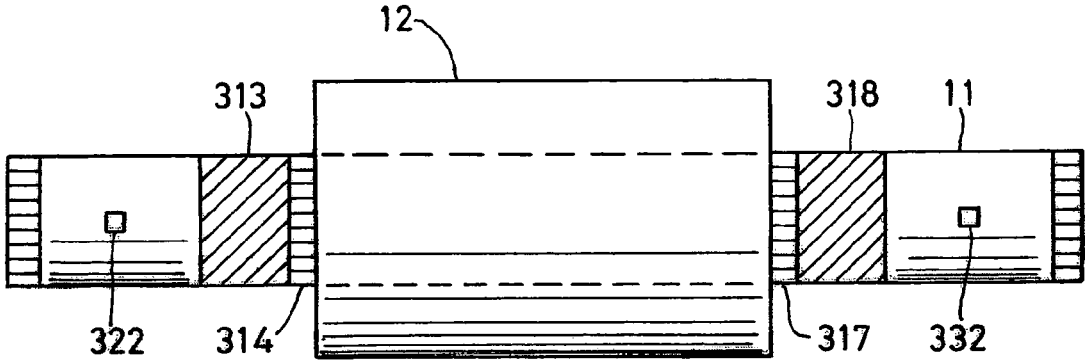

FIG. 3, which is divided up into FIGS. 3A and 3B. diagrammatically illustrates a core provided with a pattern according to the invention. FIG. 3A shows the core 11 which is provided with tooth elements 311 at its ends, such elements serving for co-operation with a drive means of the corresponding holder in the drawer as shown in FIG. 2. In addition, a number of lugs 312, 322 and 332 are shown, which have the function of releasably fixing a roll of the substrate on the core. For this purpose, a roll of substrate whether or not provided with its own core, for example of cardboard, which roll has a cylindrical cavity around its axis with a diameter somewhat larger than the diameter of the core, is pushed over the core until it has reached the required position. The lugs are then rotated outwards against the inner edge of the cylindrical cavity of the roll. For this purpose, element 311 is mounted rotatably on core 11 and connected via a transmission to the lugs 312, 322 and 333. By turning the lugs outwards a clamping action occurs so that the roll is fixed on the core.

The core is provided with a pattern built-up of a number of differently colored zones 313 to 318. These zones form strips which extend around the core. The strips are so disposed that the pattern is mirror-symmetrical with respect to the center of the core. The color of zone 313 is therefore identical to the color of zone 318, the color of zone 314 is identical to that of zone 317, and the color of zone 315 is identical to the color of zone 316. In the embodiment illustrated, the colored zones occupy a part of the core which corresponds with the width of the smallest possible roll still printable in the printer. The width is indicated by Mi in FIG. 3A. The zones extend just past the width of the widest possible roll still printable in the printer. This width is indicated by Ma in the drawing. In this way the pattern can be used to an optimal effect in positioning each roll of substrate mounted on the core so that it can be printed in the printer.

FIG. 3B shows the way in which a pattern can be used in positioning the roll of substrate 12 on the core 11. The roll is pushed over the core until the part of the pattern projecting on the left of the roll outside the roll is equal to the part of the pattern projecting outside the roll on the right-hand side. The center of the roll then coincides with the center of the core.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising a print unit, a supply unit for holding a web of receiving material wound into a roll, and means for unwinding the web and transporting it for printing to the print unit, said supply unit being adapted to carry an elongated member on which the roll is fixed and concentrically mounted thereon, the elongated member being provided at its peripheral edge with a pattern of sensorially perceptible discrete transitions which extends in a direction perpendicular to the direction in which the elongated member itself extends, said pattern being substantially symmetrical with respect to a reference position on the elongated member and extends from the reference position as far as the vicinity of the ends of the elongated member.

2. The printer according to claim 1, wherein the pattern is such that it contains at least three discrete transitions differing from one another.

3. The printer according to claim 2, wherein the pattern comprises at least three consecutive zones extending in the longitudinal direction of the elongated member, said zones being separated from one another by the discrete transitions, said zones being provided with a color indication which differ from each another.

4. The printer according to claim 3, wherein no zones having the same color indication occur in a series of consecutive zones in which there are at least three discrete transitions between said zones.

5. The printer according to claim 3, wherein each zone substantially encircles the member.

6. The printer according to claim 3, wherein the zones adjoin one another.

7. The printer according to claim 1, wherein the web is rolled on a tube, said tube being releasably fixed on the elongated member.

8. The printer according to claim 1 wherein a sensor is provided to measure the position of a side edge of the unwound part of the web.

9. A supply unit for holding a web of a receiving material wound into a roll, comprising means for rotatably accommodating an elongated member on which the roll is fixed substantially concentrically, the elongated member being provided at its peripheral edge with a pattern of sensorialty perceptible discrete transitions which extends in a direction perpendicular to the direction in which the elongated member itself extends, said pattern being symmetrical with respect to a reference position on the elongated member and extends from said position to the vicinity of the ends of the elongated member.

10. An elongated member comprising means for the releasable fixing of a web of receiving material wound into a roll, said elongated member being provided at its peripheral edge with a pattern with sensorially perceptible discrete transitions which extends in a direction perpendicular to the direction in which the elongated member itself extends, such that said pattern is suitable, prior to said fixing, for positioning the roll on the elongated member, said pattern being symmetrical with respect to a reference position on the elongated member and extending from the reference position to the vicinity of the ends of the elongated member.

11. The printer of claim 1 wherein said printer is an ink jet printer.

* * * * *